US005987293A

United States Patent [19]

Diels

[11] Patent Number: 5,987,293

[45] Date of Patent: Nov. 16, 1999

[54] SYSTEM FOR APPLICATION OF FUSER OIL TO A FUSING UNIT

[75] Inventor: Bart Diels, Oud-Turnhout, Belgium

[73] Assignee: Agfa-Gervaert N.V., Mortsel, Belgium

[21] Appl. No.: 09/035,527

[22] Filed: Mar. 5, 1998

[30] Foreign Application Priority Data

Mar. 14, 1997 [DE] Germany ..... 97200779

[51] Int. Cl.[6] ..... G03G 15/20

[52] U.S. Cl. ..... 399/325

[58] Field of Search ..... 399/324, 325, 399/326, 327

[56] References Cited

U.S. PATENT DOCUMENTS

| | | | |
|---|---|---|---|
| 4,397,936 | 8/1983 | Sakata et al. | 430/124 |
| 5,235,394 | 8/1993 | Mills, III et al. | 399/325 |
| 5,485,259 | 1/1996 | Uehara et al. | 399/325 |
| 5,504,566 | 4/1996 | Chow et al. | 355/284 |
| 5,678,153 | 10/1997 | Okamoto et al. | 399/327 |
| 5,732,316 | 3/1998 | Yamasaki et al. | 399/321 |

FOREIGN PATENT DOCUMENTS

| | | |
|---|---|---|
| 04318584 | 11/1992 | Japan . |
| 05127555 | 5/1993 | Japan . |
| 8-95416 | 4/1996 | Japan . |
| 8-272257 | 10/1996 | Japan . |

*Primary Examiner*—Joan Pendegrass
*Attorney, Agent, or Firm*—Baker & Botts, L.L.P.

[57] ABSTRACT

The fuser roller in a fixing unit of a (duplex) electrographic copying or printing apparatus is provided with an oil application system having an oil sump, two metallic rollers for delivery of fusing oil to a applicator roller contacting the fuser roller. The system is characterized by an oil transfer coefficient C which is not higher than 0.5 in order to avoid visible stepwise variation of fuser oil offset on the final copy. The system can further be provided with an oil compensation roller for further improvement of oil distribution on the copy and can be equipped with a cleaning system to remove picked-up impurities.

11 Claims, 2 Drawing Sheets

SYSTEM FOR APPLICATION OF FUSER OIL TO A FUSING UNIT

BACKGROUND OF THE INVENTION

1. Field of the Invention

The present invention relates to a fixing device for an electrographic (colour) printing apparatus in which for example two images on both sides of a receiving member can be fixed in one step.

2. Description of the Prior Art

In an electrophotographic black-and-white printing machine, a photoconductive member is charged to a substantially uniform potential to sensitize the surface thereof. The charged portion of the photoconductive member is image-wise exposed. Exposure by irradiation of the charged photoconductive member selectively dissipates the charge thereon in the irradiated areas. As a result an electrostatic latent image is recorded on the photoconductive member corresponding to the informational areas contained in the original document being reproduced. After the electrostatic latent image is recorded on the photoconductive member, the latent image is developed by bringing a charged toner brush into contact therewith. A developed toner image is formed on the photoconductive member. The toner image may be subsequently transferred in one or more steps to a receiving member. The receiving member carrying the toner image is then heated to permanently affix the toner image thereto in image configuration. A toner image can also be obtained using other electrographic systems. In direct electrostatic printing for example switchable aperture electrodes image-wise regulate the toner transfer through the printhead to the receiving medium. Multicolour electrophotographic printing is substantially identical to black and white printing described hereinbefore. However, rather than forming a single latent image on the photoconductive surface, successive latent part-images corresponding to different colours are recorded thereon. Starting from colour separation information obtained by scanning or computing an image according to the additive colour system using red, green and blue (RGB), the part-image forming data is calculated for obtaining an electrostatic latent image which is preferable developed with a toner of the subtractive colour system using magenta, yellow and cyan toner.

This process is repeated at the image forming station or duplicated at plural image forming stations for the respective subtractive colour system toners (YMC). A fourth image using black toner can be included to provide better image reproduction. Each single colour component toner image is transferred to the receiving member sheet in superimposed registration with the prior toner image, thereby creating a multilayered toner image on the receiving member. Thereafter, the multilayered toner image is permanently fixed to the receiving member creating a colour copy or print.

The fixing is usually done by a fusing apparatus comprising two pressure rollers exerting pressure to the receiving member which is fed in between the rollers. Due to the pressure the toner compacts and adheres to the receiving member. Usually at least one of the rollers is heated in order to cause melting of the toner providing fast and high quality fixing of the copy. This provides a capability of a high throughput fixing apparatus. A problem herein is that the melted toner not only adheres to the receiving member, but also tends to adhere to the fixing rollers which exert pressure and heat to the receiving member. This causes smearing of the rollers, resulting in image quality defects in copies made hereafter.

To avoid these problems and to exert a uniform pressure, the fixing rollers are usually made of a rubber material having a low affinity for the toner composition. To even further diminish the toner offset to the rollers a releasing agent is applied to the fixing rollers. This is usually a type of silicone fuser oil forming a thin layer on the fixing rollers. This oil usually is applied to the fuser roller by a contacting oil application roller on which a constant oil film is applied by an oil applicator and metering blade. The oil ensures no tacking of the toner to the fixing roller. Such a system is described in U.S. Pat. No. 5,504,566 wherein an oil application system uses a dual metering blade. However a small portion of the oil applied to the fixing roller is also transferred to the final copy, which is fixed in the fuser. This thin oil film results in a light gloss visible in the final copy.

This oil offset also results in a change in the amount of oil present on the fixing rollers even if a fresh supply is provided. In order to maintain good toner offset properties, the amount of oil on the fusing rollers has to be maintained at a certain level.

Another problem arises when the thickness of the oil film deposited on the copy varies within one page. The visible variation of gloss results in a degraded image quality to the viewer. In order to counteract these problems a rapid variation of the oil film thickness has to be avoided. It can be seen that there is still a need for a better control of silicone oil application to maintain good offset properties and a high image quality.

When the fuser is activated without actually fusing copies, the oil application system ensures a maximum of oil deposited upon the fuser rollers.

If the fuser is used to fuse a continuous web of paper, the oil film on the rollers diminishes each revolution until a minimum value is reached. At this point the amount of oil offset on the paper equals the amount of oil supplied by the applicator system. This maximum and minimum value can be calculated and measured. Normal copy or print operation however cannot be compared to either situation. In between copies the amount of oil on the rollers increases whereas it decreases when a sheet is fed through the nip. This decrease is not continuous as the length of the paper sheet normally exceeds the circumference of the fuser roller. During the first revolution of the fuser roller in contact with the leading portion of the receiving sheet, the fuser roller is fully oiled and a certain amount of oil transferred to the paper. During the second revolution of the fuser roller in contact with the second portion of the receiving paper there is less oil on the roller and a smaller amount of oil is transferred to the paper. During further revolutions the amount of oil on the roller will diminish to the minimum value. The transition of two areas having a different oil coverage occurs in discrete steps clearly visible to the viewer.

A further problem which arises is the fact that several systems using metering blades or wicks cause premature wear of the fusing rollers due to sliding contacts.

An oil application system in a fuser is normally provided only for the roller contacting the toner image. Till now no oil application system is provided for fusing a duplex copy wherein the two toner images on both sides of the receiving layer are fused simultaneously.

OBJECTS OF THE INVENTION

It is an object of the invention to provide a (duplex) fusing unit having an oil application system providing an appropriate supply of fusing oil to the fusing system to maintain a good image quality. Further objects and advantages will become apparent from the description hereinbelow.

SUMMARY OF THE INVENTION

In accordance with the present invention there is provided a heat pressure fixing device for fixing electrographic toner onto a receiving layer carrying at least one toner image on at least one side comprising:

at least one fuser roller for contacting said toner image to be fixed, an oil application system for contacting said fuser roller for applying fuser oil to said fuser roller, having an oil transfer coefficient C representing the relative affinity of the fuser oil to the fuser roller, wherein said device is characterised in that the oil transfer coefficient C of said oil application system to said fusing roller is not higher than $0.5:C \leqq 0.5$. The oil transfer coefficient C is defined as $$C = \frac{t_{i+1}}{(t_i + h)}$$

where $t_{i+1}$=amount of oil on the fuser roller after contact with the oil application system.

$t_i$=amount of oil on the fuser roller before contact with the oil application system and equals the amount of oil remaining on the fuser roller after contact with the receiving sheet during the previous rotation.

h=amount of oil on the applicator roller before contact with the fuser roller

The oil application system preferably comprises an oil application roller contacting the fuser roller applying the fusing oil to the fuser roller.

In order to further improve equal fuser oil distribution and smaller oil coverage variation the fuser roller is preferably provided with at least one oil compensation roller in contact with the fuser roller.

In order to obtain an even better control of the amount of applicated oil, means can be provided for controlled removal of contact between the oil application roller and the fuser roller.

Further improvements can be accomplished by providing means for controlled removal of the contact between the compensation roller and fuser roller.

Even more preferably the contact of the fusing roller with the oil application system and/or the contact of the fusing roller with the compensation roller include or solely include rolling contacts within the active fusing width. This prevents excessive damage to the fusing roller.

In a preferred embodiment the oil application system comprises two metallic rollers delivering fusing oil from the oil sump to the oil application roller having a rubber surface. This surface can be obtained by making use of a rubber sleeve mounted over the rolls core or the core can be coated with a rubber surface by using miscellaneous coating processes.

In another preferred embodiment the compensation roller is in contact with a cleaning system having a cleaning roller in contact with the compensation roller for picking up impurities collected by the compensation roller optionally a cleaning blade contacting the cleaning roller to remove impurities from the cleaning roller.

According to the present invention there is further provided a device for duplex fixing wherein an oil supply system is provided for a second fuser roller making contact with said fuser roller.

BRIEF DESCRIPTION OF THE DRAWINGS.

The invention will be described hereinafter by way of example with reference to the accompanying drawings wherein.

DETAILED DESCRIPTION OF THE INVENTION.

Figure 1:
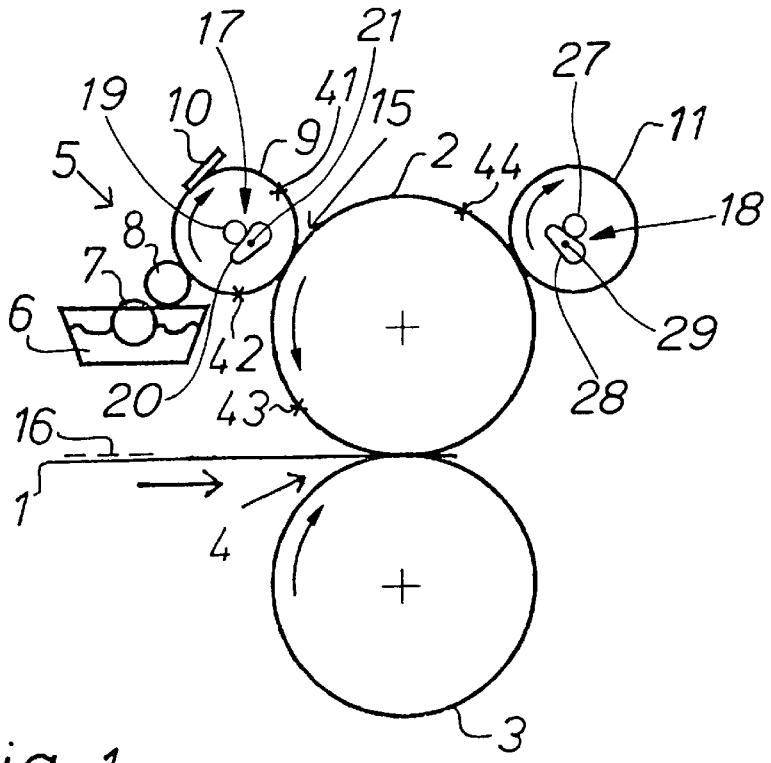
FIG. 1 is a diagrammatic representation of an embodiment of a fixing device according to the present invention, comprising a compensation roller.

FIG. 1 shows a diagrammatic representation of one embodiment of a fixing device according to the present invention.

Receiving sheet 1 carrying a toner image on the upper side is fed into the nip area 4 of the two fixing rollers. The fixing station is provided with a heated fuser roller 2 and a pressure roller 3. The sheet 1 passes through the nip 4 defined by the fuser roller 2 and the pressure roller 3. The toner image contacts the fuser roller 2, and by the pressure and heat the toner melts and is fixed to the receiving sheet 1. Thereafter the sheet 1 is collected in a receiver tray.

In a specific embodiment the heated fuser roller 2 having a diameter of 73.5 mm is composed of an aluminium core of 4.25 mm thickness and has a rubber coating of 2.5 mm rubber having a hardness value of 40 Shore A. The rubber coating consists of three layers:

core of filled silicone rubber a transition layer an outer layer of pure, unfilled silicone rubber.

The core of the fuser roller 2 may be made of various materials such as copper, iron, aluminium, nickel, stainless steel, etc. Inside the core there is a heating element supplying the heat for the fusing operation. The heating element may consist of a tungsten-quartz lamp providing infrared radiation, although many other heating elements are known in the art. Heating can alternatively be done by an internal heating means, an external heating means or a combination of both.

The fuser roller 2 is in contact with the pressure roller 3. Both form a nip 4 where sufficient heat and pressure can be applied to the receiving sheet 1 so that the toner image can be fixed to the sheet 1.

In order to prevent toner offset to the surface of the fusing roller 2 a releasing oil application system 5 is provided in contact with the fuser roller 2.

The oil application system 5 comprises an oil sump 6, oil supply rollers 7 and 8 and the oil applicator roller 9 applicating the oil to the fusing roller 2. In one embodiment the oil application roller 9 contacting the fuser roller 2 has a diameter of 30 mm and consists of a steel core with an outer diameter of 15 mm, a layer of 6 mm foam rubber and an outer layer of 1.5 mm of silicone rubber. In order to ensure a uniform constant thickness of oil on the applicator roller 9 a metering blade 10 may be provided.

It has been found that no oil build-up occurs just before the nip 15 of the application roller 9 and the fusing roller 2. The total sum of 1) the amount of oil supplied by the applicator roller 9 and 2) the amount of oil present on the fuser roller 2 just before the applicator roller 9, is fed through the nip 15 and is redistributed between 1) the applicator roller 9 and 2) the fuser roller 2 according to the transfer coefficient C.

Thus:

$$t_i+h=t_{i+1}+h'$$

wherein $t_i$=amount of oil on the fuser roller 2 at position 44 before contact with the oil application system 5 and equals the amount of oil remained on the fuser roller 2 after contact with the receiving sheet 1 during the previous rotation.

$t_{i+1}$=amount of oil on the fuser roller 2 at position 43 after contact with the oil application system 5.

h=amount of oil on the applicator roller 9 at position 41 before contact with the fuser roller 2.

h'=amount of oil retained by the applicator roller 9 at position 42 after contact with the fusing roller 2.

The above amounts of oil can be expressed in thickness ($\mu$m) or in mass/unit area ($\mu$g/unit area) or in volume/unit area ($\mu$l/unit area).

All these values relate to each other in a linear manner.

The oil transfer coefficient between the applicator roller 9 and the fuser roller 2 can be defined as:

$$C = \frac{t_{i+1}}{(t_i + h)} \tag{1}$$

This is a value representing the relative affinity of the fusing oil for the applicator roller 9 and the fusing roller 2 in the oil application process.

The oil transfer coefficient C of the applicator roller 9 to the fusing roller 2 has a value of not more than 0.5 while h in this embodiment typically has a value of about 0.7 $\mu$m oil thickness on the applicator roller 9.

In order to make an estimation of the amount of fusing oil available on the fuser roller following calculations can be made:

When the fixing unit is activated without actually fusing a sheet, the oil coverage of the system will build up until a maximum is reached. It can be seen that the equilibrium at the maximum level can be described by following equations:

$$t_{i+1}=t_i \tag{2}$$

since no oil thickness variation occurs on the fuser roller 2. Since by solving $t_i$ from equation (1), the following equation follows:

$$t_i = \frac{t_{i+1} - C \times h}{C} \tag{3}$$

it can be calculated from the above equation (3) and substitution of equation (2) that:

$$t_{i+1} = \frac{h \times C}{(1 - C)} \tag{4}$$

As the fully oiled fuser roller firstly contacts a sheet 1, a portion of the oil content of the fuser roller 2 transfers to the receiving paper 1.

A similar oil transfer coefficient A can be defined for the fuser roller/paper contact although the unfixed receiver sheet 1 makes no contribution to the amount of oil present the nip 4 of the fuser roller 2 and receiving sheet 1.

$$A = \frac{t_p}{t_{i+1}} \tag{5}$$

where $t_p$=the amount of oil retained by the front side 16 of the receiving sheet 1 which is in contact with the fuser roller 2.

$t_{i+1}$=amount of oil on the fuser roller 2 at position 43 after contact with the oil application system 5.

A has a typical value of about 0.72 depending on the type of paper used in the printer/copier.

After the first contact of the fusing roller with the receiving sheet to be fixed, the amount of oil $t_{1,i}$ which remains on the fixing roller 2 at position 44 can be found by combination of formula (4) and (5):

$$t_{1,i} = \frac{h \times C}{(1 - C)} \times (1 - A) \tag{6}$$

where $t_{1,i}$=amount of oil left on the fuser roller 2 at position 44 after contact with the sheet 1 during the first rotation A=The oil transfer coefficient of the fuser roller/paper contact.

When a constant fixing is done (supposing the presence of a continuous web of receiving material 1) the oil coverage of the fusing roller 2 diminishes until a minimum is reached in a stable dynamic system.

At minimum equilibrium the oil coverage of the paper equals the oil pick-up by the fuser roller 2, because:

$$t_{i+1}=t_i+t_p$$

and by substitution of formula (3) and (5) it follows:

$$t_{i+1} = \frac{h \times C}{(1 - C \times (1 - A))} \tag{7}$$

When considering the oil coverage variation of the fuser roller 2 at position 43 after the contact with the oil application system 5 before first contact with the receiving layer 1 during the first revolution of the fuser roller 2 to the second revolution of the fuser roller 2 it can be stated that:

$$t_{1,i+1} = \frac{h \times C}{(1 - C)} \tag{8}$$

for the first revolution and by combining formula (6) and (1) is can be calculated that:

$$t_{2,i+1} = \left(\frac{h \times C \times (1 - A)}{1 - C} + h\right) \times C \tag{9}$$

for the second revolution, where $t_{1,i+1}$=the amount of oil present on the fully loaded fuser roller 2 at position 43 during first revolution of the fuser roller 2 before contact with the paper.

$t_{2,i+1}$=the amount of oil present on the fuser roller 2 at position 43 during second revolution of the fuser roller 2 before contact with the paper.

It can be calculated that the ratio $t_{2,i+1}/t_{1-i+1}$ of available oil on the fuser roller 2 for the first revolution to the available oil on the fuser roller 2 during the second revolution at position 43 is given by the following equation:

$$t_{2,i+1}/t_{1,i+1}=1-A\times C \quad (10)$$

It was observed that when C is lower or equal than 0.5 no visible oil-coverage variation appears on the final print which results in a high image quality appreciation by the viewer.

In one embodiment the oil is supplied to the applicator roller 9 by two metal rollers 7 and 8 picking up the oil out of the oil 6 sump. A metering blade 10 contacting the oil application roller 9 regulates the fresh oil supply to the fuser roller 2.

In a preferred embodiment the fixing unit further provides a compensation roller 11 contacting the fusing roller 2. This enables further reduction of variation in oil coverage of the copy sheet. When the fixing unit is activated while no sheet is fed through, the compensation roller 11 builds up a supply of fusing oil. The maximum oil capacity of the compensation roller 11 depends on the relative affinity for fusing oil of the fuser roller 2 and compensation roller 11. After several rotations a maximum value in oil storage is reached. When actual fixing of toner images takes place, the amount of oil on the fuser roller diminishes and the compensation roller gradually returns the stored oil and helps reducing variation of the oil coverage of the fusing roller and the visible oil coverage variations on the copy sheet.

Figure 2:
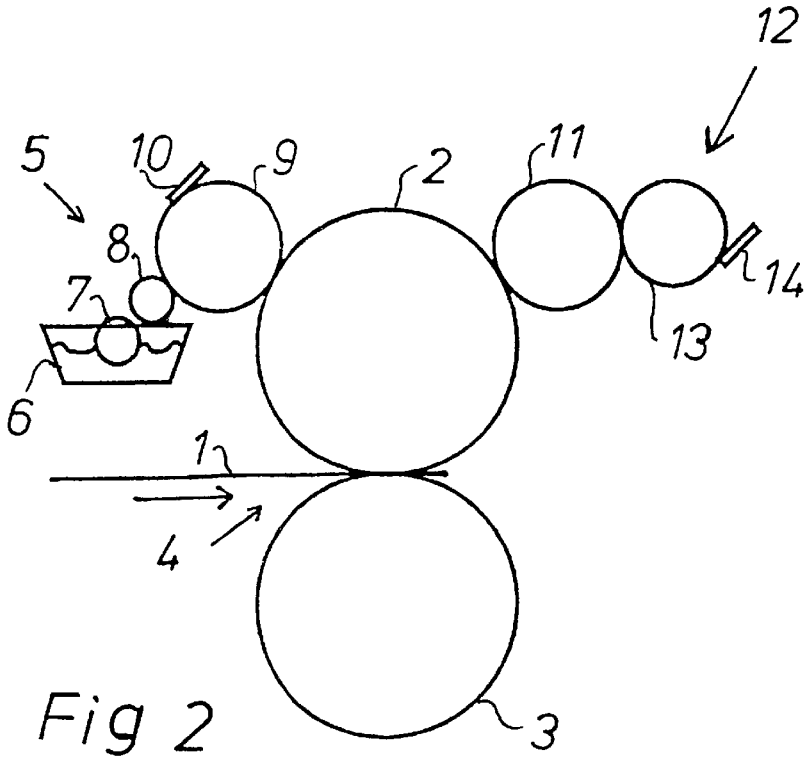
FIG. 2 is a view of another embodiment of a fixing device comprising a cleaning roller and cleaning blade.

A second embodiment of the fusing unit is described in conjunction with FIG. 2. A nearly identical fixing station is provided having oil sump 6, metal oil supply rollers 7 and 8, applicator roller 9, fusing roller 2, pressure roller 3 and compensation roller 11. In this embodiment a cleaning section 12 is provided on the compensation roller 11 comprising:

a cleaning roller 13 contacting the compensating roller 11 picking up impurities from the compensating roller 11 collected from the fuser roller 2 during image fixing operation, a cleaning blade 14 contacting the cleaning roller 13 scraping off the impurities accumulated on the cleaning roller 13. As in the previous embodiment all the parts contacting the fuser roller 2 do this preferably in a rolling manner. No rubbing or scraping elements are present. This ensures a longer life-time of the fuser roller 2. The rollers contacting the fuser roller 2 normally are driven by separate driving means. An even further reduction in wear caused by rotation speed differences can be accomplished when the contacting rollers are driven by the fuser roller 2 itself by friction contact. Thus speed differences between contacting rollers may be avoided.

Figure 3:
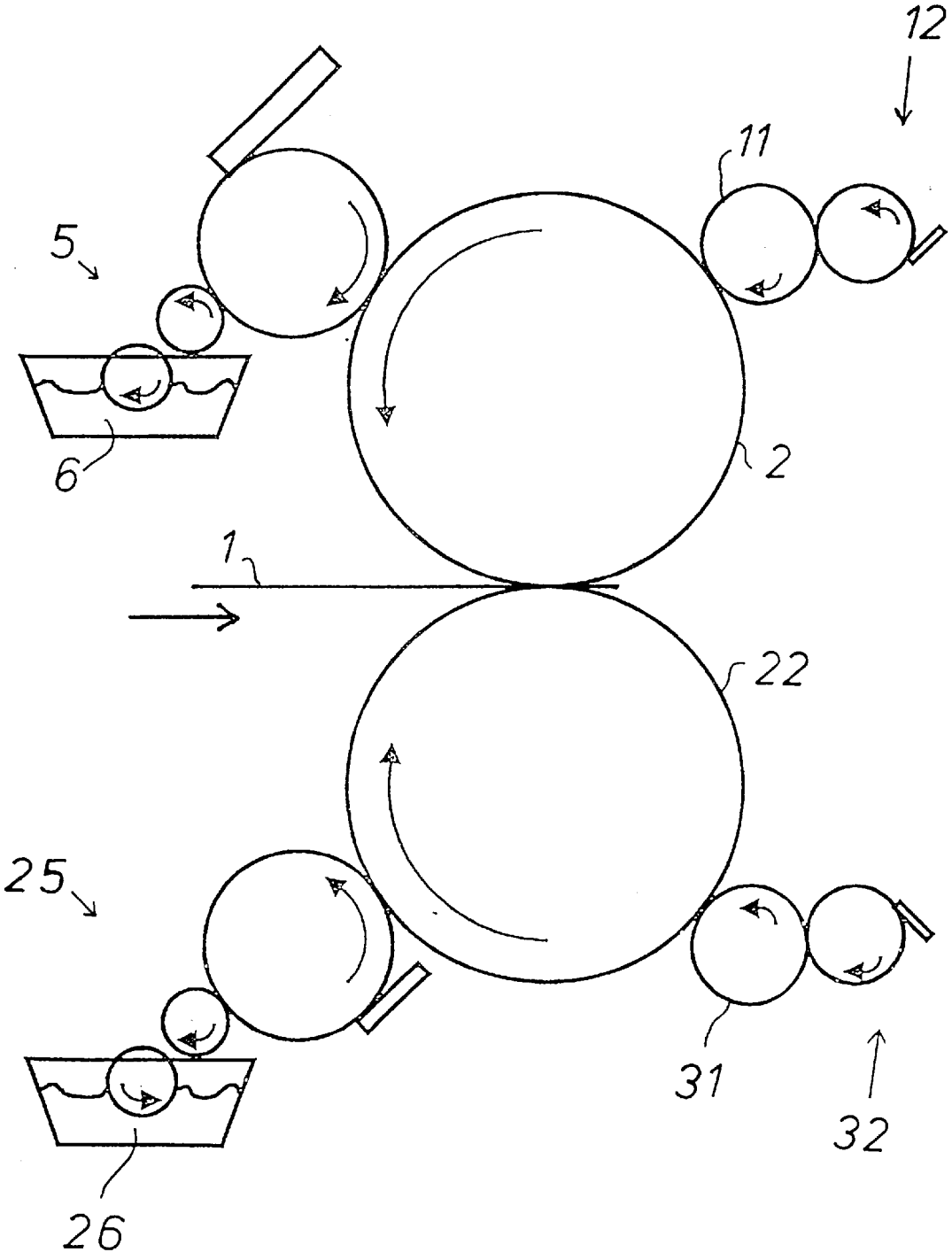
FIG. 3 is a diagrammatic view of a duplex fixing device according to the present invention.

FIG. 3 shows a duplex fixing station according to the present invention. In a duplex copying apparatus the receiving sheet 1 carries a toner image on both sides. The embodiment is capable of fusing both toner images simultaneously by the fixing unit. Instead of one fuser roller 2 and a pressure roller 3, two fuser rollers 2,22 are provided each in contact with one side of the copy sheet 1. Both fuser rollers 2,22 can be provided with a substantially identical oil supply system 5,25. Each of the fuser rollers 2,22 can also be provided with a compensation roller 11,31 both optionally with a cleaning system 12,32 respectively. The cleaning system 12,32 of each compensation roller 11,31 can comprise a cleaning roller as well as an optionally cleaning blade. In this way a balanced oil supply is provided for both fuser rollers 2,3.

When the oil application systems 5,25 are in an unbalanced situation and when the fuser is activated without receiving paper fed through, the oil sump e.g. 6 of the system applying the most oil will loose oil whereas the oil sump 26 of the system applying the least oil will, via the contacting fuser rollers 2,22 pick up the lost oil, feed it back to the oil sump 26 which will receive more and more oil and will eventually overflow.

Overflow can be avoided by feeding excess of oil back to the main tank containing fuser oil. The excess of oil is thus recycled to be used again. Optionally a filtering step may be applied to the reflowing oil volume.

Other solutions can be found to reduce the above oil pumping effect. The rotation speed of the fuser rollers 2,22 can be slowed down when no receiving sheet 1 is fed through. Another method comprises the interruption of the line of contact between the two oil sumps. This can be accomplished by retracting at least one of the oil application systems 5,25. Even switching to a non-contact situation of the two fuser rollers 2,22 results in the interruption of the pumping effect of the non-balanced oil application systems.

In an other embodiment the fusing unit has an oil application system (5) comprising an oil application roller (9) contacting said fuser roller (2).

In an other embodiment the fusing unit has at least one oil compensation roller (11) in contact with said fuser roller (2).

A further embodiment comprises means (17) for controlled removal of contact between said oil application system (5) and said fuser roller (2) as shown in FIG. 1 including axis (19), cam (20) and cam axis (21).

An other embodiment comprises means (18) for controlled removal of contact between said compensation roller (11) and said fuser roller (2) as shown in FIG. 1 including axis (27), cam (28) and cam axis (29).

In an other embodiment the contact of the fusing roller (2) with the oil application system (5) includes rolling contacts. In on other embodiment the contact of the fusing roller (2) with the compensation roller (11) includes rolling contacts. In a further embodiment the oil application system (5) has an oil sump (6), two metallic rollers (7,8) for delivery of fusing oil from the oil sump (6) to the oil applicator roller (9) having a rubber surface.

In an other embodiment the fusing device comprises a cleaning system (12), said cleaning system having a cleaning roller (13) in contact with the compensation roller (11) for picking up impurities collected by the compensation roller (11), optionally a cleaning blade (14) contacting the cleaning roller (13) to remove impurities from the cleaning roller (13).

In a last embodiment for use in duplex fixing, there is a second fuser roller having a second oil supply system (25) for contacting said second fuser roller (22) whichmakes contact with the first fuser roller (2).

I claim:

1. A heat pressure fixing device for fixing electrographic toner onto a receiving layer carrying at least one toner image on at least one side comprising:

at least one fuser roller having a surface for contacting said toner image to be fixed, an oil application system for contacting said fuser roller for applying fuser oil to said fuser roller, said oil application system and said fuser roller having an oil transfer coefficient C defined as:

$$C = \frac{t_{i+1}}{(t_i + h)}$$

$t_{i+1}$ is the amount of oil on the surface of said fuser roller after contact with said oil application system, $t_i$ is the amount of oil on the surface of said fuser roller before contact with said oil application system, h is the amount of oil on a surface of said oil application system before contact with said fuser roller, and wherein said oil transfer coefficient C is not greater than 0.5.

2. The device according to claim 1, wherein said oil application system comprises an oil application roller for contacting said fuser roller.

3. The device according to claim 2, wherein said oil application roller is in rolling contact with said fuser roller.

4. The device according to claim 2, wherein said oil application system has an oil sump, two metallic rollers for delivery of fusing oil from the oil sump to the oil applicator roller having a rubber surface.

5. The device according to claim 1, further comprising at least one oil compensation roller for making contact with said fuser roller.

6. The device according to claim 5, further comprising means for controlled removal of contact between said compensation roller and said fuser roller.

7. The device according to claim 5, wherein said oil compensation roller is in rolling contact with said fuser roller.

8. The device according to claim 5 having a cleaning system, said cleaning system having a cleaning roller in contact with the compensation roller for picking up impurities collected by the compensation roller.

9. The device according to claim 8 wherein said cleaning system has a cleaning blade for contacting said cleaning roller for removing impurities from the cleaning roller.

10. The device according to claim 1, further comprising means for controlled removal of contact between said oil application system and said fuser roller.

11. The device according to claim 1 for use in duplex fixing, having a second fuser roller and a second oil supply system for making contact with said second fuser roller.

* * * * *